US006575330B2

(12) United States Patent
Rousselet

(10) Patent No.: US 6,575,330 B2
(45) Date of Patent: Jun. 10, 2003

(54) CONTAINER CAP

(75) Inventor: Guilhem Rousselet, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/877,062

(22) Filed: Jun. 11, 2001

(65) Prior Publication Data

US 2002/0017535 A1 Feb. 14, 2002

(30) Foreign Application Priority Data

Jun. 9, 2000 (FR) ..... 00 07445

(51) Int. Cl.[7] ..... G01F 11/00

(52) U.S. Cl. ..... 222/1; 222/213; 222/494; 222/546; 222/556

(58) Field of Search ..... 222/1, 212, 213, 222/491, 494, 546, 556, 570

(56) References Cited

U.S. PATENT DOCUMENTS

| | | | | |
|---|---|---|---|---|
| 2,758,755 A | * | 8/1956 | Schafler | 222/213 |
| 3,124,281 A | * | 3/1964 | Stull | 222/542 |
| 3,645,423 A | * | 2/1972 | DeGraw | 222/207 |
| 4,386,714 A | | 6/1983 | Roberto et al. | |
| 4,403,712 A | | 9/1983 | Wiesinger | |
| 4,573,600 A | | 3/1986 | Dubach | |
| 4,773,570 A | * | 9/1988 | Workum | 222/189 |
| 5,169,035 A | | 12/1992 | Imbery, Jr. | |
| 5,458,274 A | * | 10/1995 | Maietta | 222/39 |
| 5,617,978 A | * | 4/1997 | Geier | 222/402.13 |
| 5,894,962 A | * | 4/1999 | Song et al. | 222/213 |
| 5,927,568 A | | 7/1999 | De Nervo et al. | |
| 6,257,431 B1 | * | 7/2001 | Baudin | 215/237 |
| 6,305,577 B1 | * | 10/2001 | Fillmore et al. | 222/95 |

FOREIGN PATENT DOCUMENTS

| | | |
|---|---|---|
| EP | 0 056 469 | 7/1982 |
| EP | 0 147 423 | 7/1985 |
| FR | 2 558 140 | 7/1985 |

* cited by examiner

*Primary Examiner*—Joseph A. Kaufman
(74) *Attorney, Agent, or Firm*—Finnegan, Henderson, Farabow, Garrett & Dunner, L.L.P.

(57) ABSTRACT

A cap for a container may comprise a body, an outlet orifice for dispensing a product from a container, a lid configured to selectively cover at least a portion of the outlet orifice, a snap hinge coupling the lid to the body, and at least one shut-off flap. The at least one shut-off flap may selectively allow the product to be dispensed from the outlet orifice. The at least one shut-off flap and the body may be a single piece formed of a material substantially the same as a material forming the snap hinge.

75 Claims, 3 Drawing Sheets

CONTAINER CAP

BACKGROUND OF THE INVENTION

1. Field of the Invention

The present invention relates to a cap for a container that may be used for packaging certain products, such as cosmetic products (e.g., shampoos and conditioners) or care products (e.g., body milks, moisturizing products, and sunscreens).

2. Description of the Related Art

Typically, such products are packaged in containers with deformable walls, often made of polypropylene or polyethylene, and surmounted by a neck, a free edge of which delimits an opening. Mounted on this opening, is a cap comprising a housing snap-fitted onto the neck of the container. A transverse wall of the housing has a passage passing through it. This passage may be in communication with the container. Optionally, the cap may have a top hinged to the housing via a snap hinge. The top may comprise a portion, particularly in the form of a pip, capable, when the top is closed, of engaging with the passage of the cap to substantially seal it closed.

A snap hinge may be an articulation that allows a lid or top to pass from a first position, known as a closed position, into a second position, known as a wide open position, by pivoting about an axis (defined, for example, by a film hinge), passage from the first position to the second and/or vice versa being accompanied by passage through an intermediate position of unstable equilibrium in which the elastic deformation (e.g., bending, compression, stretching, etc.) of at least part of the cap, particularly of a connecting element connecting the housing of the cap to the top, passes through a maximum value. The unstable equilibrium may result from an elastic return force generated by the elastically deformed element(s), often by the connecting element connecting the housing to the top.

Several types of snap hinges are available. For example, as described in U.S. Pat. No. 4,386,714, the connecting element may be in the form of a latch lock lever including an elbow, the opening of which is at its maximum on passing through the intermediate position. Another type of snap hinge, in which the connecting element includes a band that deforms in elongation, is described in EP 0 147 423. Yet another type of connecting element is described in EP 0 56 469. Still other types of snap hinges are also used. In the EP 056 469 patent, the connecting elements may deform little if at all. It is the cap and/or the cover that deform on passing through the position of unstable equilibrium.

Snap hinges are one example of a way to make it possible to produce a cap in a single piece, for example, a molded piece. Relatively rigid materials, such as certain polypropylene, may result in a satisfactory springing effect. If such rigidity is not achieved, the cap may operate sloppily and may be deemed unsatisfactory.

In such caps, a flap configured in such a way as to move aside under the pressure of the product inside the container may allow product to be dispensed, and the flap may return to its closed position when the pressure ceases, to be positioned in the passage delimited by the housing. Such a flap may make it possible to reduce (at least during a period of normal inversion of the container) a liquid contained in the container from flowing out under gravity. Furthermore, it may allow better control for the dispensing of the product in response to the deformation of the walls of the container.

An optional use of the flap may be to close the orifice sufficiently to prevent liquid (particularly water) from entering the container from the outside. Optionally, such a flap may allow air to enter the container, after a dispensing operation, to compensate for the volume of product dispensed.

The flap may be flexible and supple enough to allow for easy dispensing of the product. The material of the flap may also withstand numerous flexing operations in both directions, each time the product is dispensed. Ideally, an articulation connecting the flap to the body may not break after a number of uses, but may maintain its ability to return elastically to the closed position after use, and to do so throughout the life of the product. Some optional characteristics relating to the suppleness of the material relate to when the flap, on returning to its closed position, allows air to be taken into the container. This is because the flap may be subjected to bending operations that are just as repetitive, but through a maximum angle that may be bigger.

Starting out from these observations, particularly as regards the diametrically opposed properties that the materials forming, on the one hand, the snap hinge and, on the other hand, the selective shut-off door have to exhibit, specialists in such caps have hitherto resorted to the same solutions.

A first solution consists in molding the cap equipped with a snap hinge using a rigid material, particularly a polypropylene, and making a protrusion from an elastomeric material. Although satisfactory from the operational point of view, such caps can have the disadvantage of being expensive to produce due to the use of two distinct materials. Two materials can make molding more complicated. Furthermore, with certain elastomeric materials there can be a problem of compatibility of the elastomer with the product packaged in the container.

According to a second solution, described, for example, in utility certificate application FR 2 558 140, a protrusion is made of the same material as the material forming the body of the cap, and is molded as a single piece with the cap body. The material used is of relatively low rigidity, so as to meet the requirements of good operation of the protrusion. The cap cover, for its part, can be made separately from the cap, and can be mounted tightly or screwed onto the container. In other words, the snap hinge function is omitted. Just as with the first solution, this second solution may not be satisfactory from the cost point of view. Furthermore, the cap cover, which is not hinged to the cap, may become lost if care is not taken in immediately refitting it after each use. Finally, attaching such a cap, made of a material of relatively low rigidity, by snap fastening, may prove problematical as regards the robustness it affords.

In a third solution, it has been proposed for the cap to be produced as a single piece with a cover hinged to a housing by means of a snap hinge. The cap may be made of a rigid material that may meet the requirements of good articulation operation. By contrast, there is no flap arranged in the a passage. With this solution, unless the passage is dimensioned appropriately to suit the viscosity of the product, the latter flows out quickly under the effect of its weight when the bottle is held head down. Liquid, particularly water, can enter the container from the outside when the cap cover is not flipped down onto the body. Furthermore, dispensing is difficult to control.

SUMMARY OF THE INVENTION

In one optional embodiment, the invention may include a cap for a container. The cap may comprise a body, an outlet orifice for dispensing a product from a container, a lid configured to selectively cover at least a portion of the outlet orifice, a snap hinge coupling the lid to the body, and a valve. The valve may comprise, for example, at least one shut off-flap. The valve (e.g., shut-off flap) may selectively allow the product to be dispensed from the outlet orifice. The valve and the body may be a single piece formed of a material substantially the same as a material forming the snap hinge.

In an optional embodiment, the valve may comprise a least one shut-off flap configured to move from a first position, covering the outlet orifice, to a second position, enabling the product to be dispensed from the outlet orifice, in response to an increased pressure in the container. The at least one shut-off flap may be configured to return to the first position when the increased pressure ceases.

In another optional embodiment, the at least one shut-off flap may be configured to move from the first position to the second position by bending. The at least one shut-off flap may be configured to provide a liquid-tight seal for the outlet orifice when at least one shut-off flap is in the first position.

Optionally, the at least one shut-off flap may be configured to allow air to enter the container to compensate for a volume of the product dispensed when at least one shut-off flap is in the first position. For example, the at least one shut-off flap may be configured to move to a third position inward, toward the container, to allow air to enter the container when the increased pressure in the container ceases.

Optionally, the cap may be a single piece formed by molding. For example, the cap may be molded of a polypropylene material.

In an optional embodiment, the cap may include at least one bridge of material forming a hinge coupling the at least one shut-off flap to the body. For example, the at least one bridge of material may comprise two bridges of material located at a non-zero distance apart from one another.

In another embodiment, one optional location of the outlet orifice may be at a bottom of a cavity defined by the body. The cavity may have a first side located adjacent to the at least one bridge of material, and a second side located substantially opposite to the first side. A profile of the second side may be inclined with respect to the first side.

In another optional embodiment, the cap may have means for mounting the cap on the container. The mounting means may be configured to cooperate with corresponding means on the container so as to allow the cap to be coupled to the container by at least one of snap fastening and screwing.

In another aspect, the invention may include a packaging and dispensing assembly comprising a container, and a cap for the container. Optionally, the container may comprise a free edge defining an opening of the container. The cap may selectively cover the opening of the container. The assembly may optionally include a product in the container. The product may be, for example, a cosmetic product, such as a hair product and/or a care product.

In an optional embodiment of the container, at least one wall may be capable of deforming from an initial shape in response to a pressure exerted at a right angle with respect to a surface thereof, and of returning substantially to the initial shape when the exertion of pressure ceases.

Optionally, a modulus of elasticity associated with the material comprising the cap may be at least about 1450 MPa.

In another optional embodiment, the cap may comprise a body, an outlet orifice for dispensing a product from the container and a lid pivotally coupled to the body. The lid may be configured to selectively cover at least a portion of the outlet orifice. The cap may also comprise a valve (e.g., at least one flap) associated with the outlet orifice. The valve may selectively allow a product to be dispensed from the outlet orifice, wherein the body and the valve comprise a single piece formed of a material substantially the same as a material forming the lid.

Yet in another optional embodiment, the cap may comprise a body, an outlet orifice for dispensing a product from the container, and a lid coupled to the body. The lid may be configured to selectively cover at least a portion of the outlet orifice. The cap may also comprise the a valve associated with the outlet orifice. The body, the lid, and the valve may comprise a single piece formed by molding.

Another optional aspect of the invention, may include a method of applying a product. The method may include providing a package and dispensing assembly containing a product, dispensing the product from the container and applying the product to a surface.

In an optional embodiment, the product comprise one of a cosmetic product and a care product, and the applying may comprise applying the product to a body part.

Optionally, dispensing may comprise applying a force to an outer surface of the container. For example, the force may be applied in a direction substantially perpendicular to the outer surface of the container. The force may be applied by squeezing the container.

According to an optional aspect, the invention may include a cap for a container. The cap may comprise a body comprising means capable of allowing the cap to be mounted on the container. The body may have an outlet orifice passing through it. The cap may also comprise a shut-off flap mounted in the outlet orifice and capable of bending in response to pressure exerted by the product in the container so as to uncover the outlet orifice to allow some product to be dispensed, and of returning to its initial position when the pressure ceases. The cap may further comprise a lid mounted on the body via a snap hinge and intended to cover the outlet orifice removably to substantially seal the container closed. The flap may be obtained by molding with the body from a material identical to the one used to form the snap hinge.

Within the meaning of the present application, a snap hinge may be understood as meaning an articulation that allows the lid to pass from a first position, known as the closed position, into a second position, known as the open position, by pivoting about an axis (defined by, for example, a film hinge). The passage of the lid from the first position to the second position (and/or vice versa) may be accompanied by passage through an intermediate position of unstable equilibrium in which the elastic deformation (e.g., bending, compression, stretching, etc.) of at least part of the lid (e.g., particularly of a connecting element connecting the body of the cap to the lid) passes through a maximum value. The crossing of this position of unstable equilibrium upon opening and/or upon closure results from an elastic return force generated by the elastically deformed element(s), for example, by the connecting element connecting the body to the lid.

By way of example, an articulation may comprise a connecting element in the form of a band of material connecting the body of the cap to the lid. In one exemplary embodiment, on each side of the connecting band there may be two film hinges defining an axis of articulation. When the cap is in the closed position, the connecting band may be on one side of the axis of articulation. When the cap is in the open position, the connecting band may be on the other side of the axis of articulation. On passing from the open position to the closed position and vice versa, the connecting band may pass through an intermediate position of maximum elongation in which it intersects the axis of articulation.

By way of further example, the connecting band may, as described in U.S. Pat. No. 4,386,714, be produced in the form of a latch lock lever.

Thus, in spite of the ideas and doubts that may have arisen amongst specialists in caps of the aforementioned type, the applicant has discovered that in a cap of the aforementioned type, the snap hinge function and the valve (e.g., shut-off flap) could be afforded satisfactorily using the same material. The costs of manufacture may thereby reduced appreciably and functionality may be acceptable.

In one optional embodiment, valve (e.g., flap) may be configured so that, on returning to the initial position, it allows air to enter the container to compensate for the volume of product dispensed. Thus, after each dispensing operation, by returning to its initial position, the flap may travel slightly beyond its shut-off position to allow air to pass to the container. When the pressures reach equilibrium, it may return to its position of shutting off the outlet orifice from liquid flow. This re-entrant movement of the shut-off flap is not, however, essential depending in particular on how great the space between the peripheral edge of the flap and the edge delimiting the outlet orifice may be.

By way of example, the distance between the peripheral edge of the flap and the interior edge delimiting the outlet orifice may be on the order of about 0.2 mm. With such a space, in the case of a shampoo, unless the bottle is left head down for a relatively long period of time, product may not flow out under its own weight.

The cap may optionally be made by molding from a polypropylene, homopolymer or copolymer.

Optionally, the valve (e.g., shut-off flap) may be connected to the body of the cap by at least one bridge of material forming a hinge. Also as an option, valve may be connected to the body of the cap by two bridges of material located a non-zero distance apart.

According to one optional embodiment, the outlet orifice may be formed at a bottom of a depression delimited by the body. The depression, on the side of the flap opposite the one adjacent to the hinge forming bridge(es), may have a profile which, in the direction away from the outlet orifice, may converge, progressively, towards an axis thereof. Such a profile can make it possible to ensure that the product dispensed flows out roughly plumb with the orifice.

On the wall of the lid intended to face the wall of the cap in which the outlet orifice is made, means, optionally, in the form of a pip, may be provided to engage with the depression in which the outlet orifice is made, so as to improve the sealing of the assembly when closed.

Optionally, the mounting means may be capable of collaborating with corresponding means of the container so as to allow the cap to be attached to the container, particularly by snap fastening or by screwing.

According to another aspect, the invention may include an assembly for packaging and dispensing a product, for example a cosmetic product. The assembly may comprise a container containing the product and having a free edge delimiting an opening equipped with a cap according to the invention.

Optionally, the container may have walls capable of deforming in response to pressure exerted at right angles to their surface, and of returning to their initial shape when the pressure ceases. A container, such as this, may be made of polypropylene or polyethylene.

Such an assembly may be particularly suited for packaging and dispensing as cosmetic product, for example, a shampoo, a conditioner, a styling gel, a milk, or a care product.

It is to be understood that both the foregoing description and the following description are exemplary.

BRIEF DESCRIPTION OF THE DRAWINGS

The accompanying drawings are incorporated in and constitute a part of this specification. The drawings illustrate optional embodiments of the invention and, together with the description, serve to explain certain principles.

In the drawings.

DESCRIPTION OF EMBODIMENTS

Figure 1:
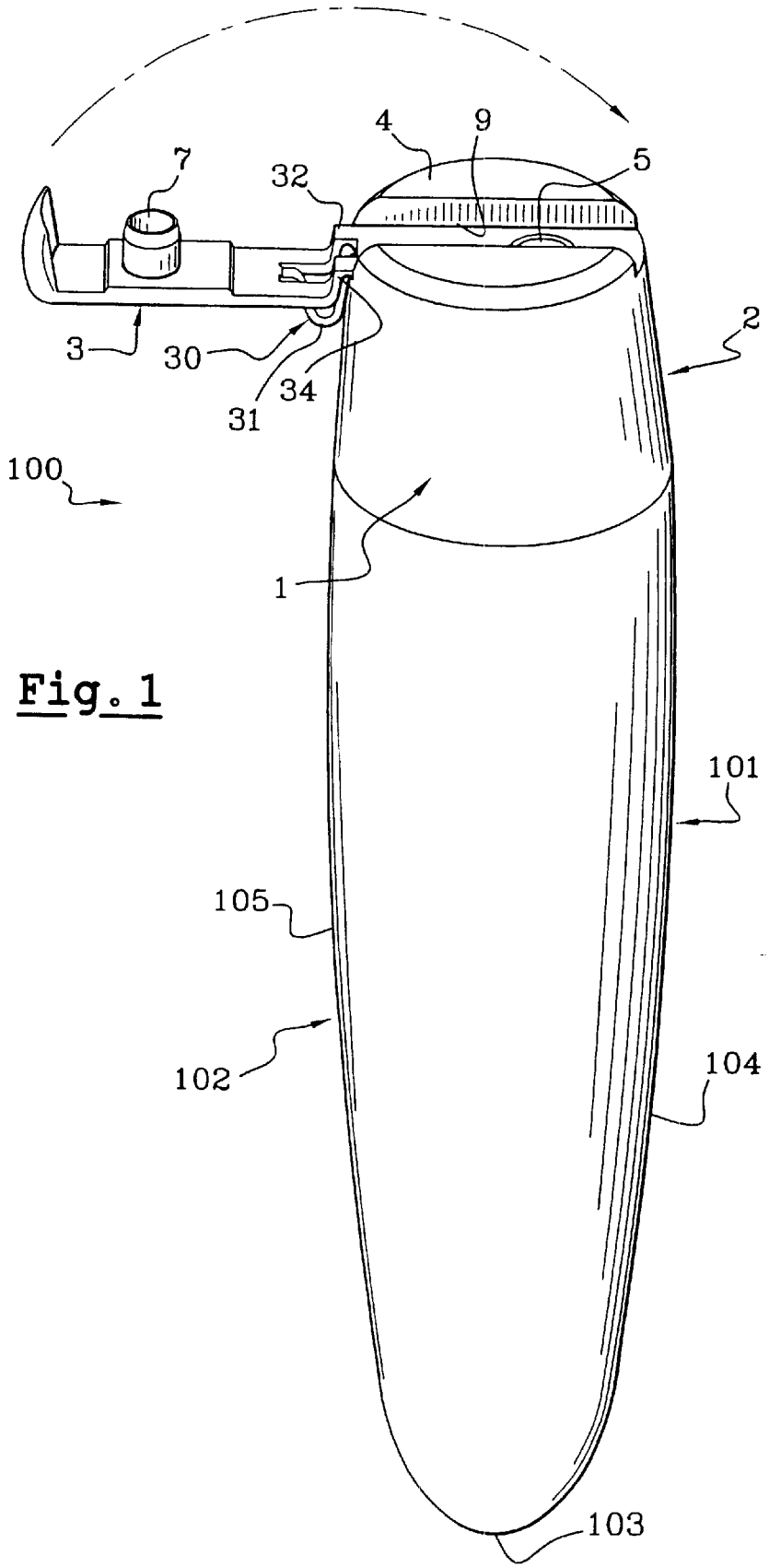
FIG. 1 is a view of an embodiment of a packaging and dispensing assembly.

Reference will now be made in detail to optional embodiments of the invention, examples of which are illustrated in the accompanying drawings. Wherever possible, the same reference numbers are used in the drawings and the description to refer to the same or like parts.

Referring to FIG. 1, an assembly 100 may comprise a cap 1 on a bottle 101. The bottle of 101 may be, made of, for example, polyethylene or polypropylene. The bottle 101 may comprise a body 102 closed by an end 103. The body 102 may have an elongate cross section and may be formed of two long faces 104, 105, which can be deformed "elastically" under the effect of pressure exerted at right angles to the long sides of the bottle.

The cap 1 may be on a neck of the bottle 101 by snap-fitting or another means of attachment. The cap 1 may comprise a body 2 to which a lid 3 may be articulated by a hinge 30 (e.g., a snap hinge). The body 2 of the cap 1 may have a transverse wall 4 in which a depression 5 may be made, at the bottom of which depression an outlet orifice 6 may be made. On a face intended to face the transverse wall 4, the lid 3 may carry a pip 7 capable of engaging in a sealed manner in the depression 5 so as to ensure good sealing when closed.

According to an optional embodiment, the cap 1 may be formed by molding as a single piece. For example, the cap 1 may be formed by molding a homopolymer polypropylene with a modulus of elasticity of 1450 MPa (measured using tests the condition of which are featured in ISO standard 178, at 2 mm/min).

Figure 2:
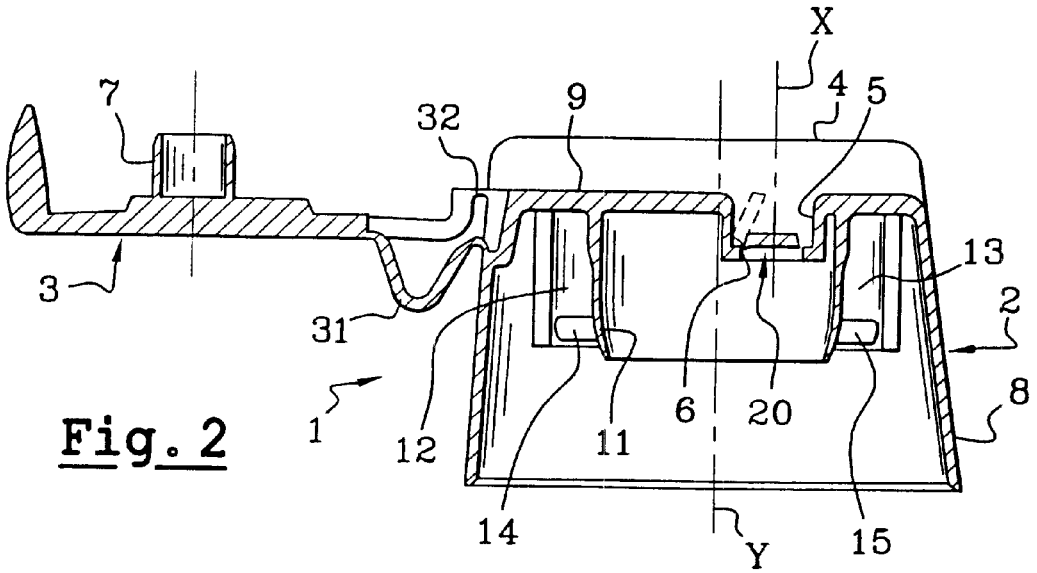
FIG. 2 is a cross-sectioned view of a cap according to an embodiment of the invention.
Figure 3:
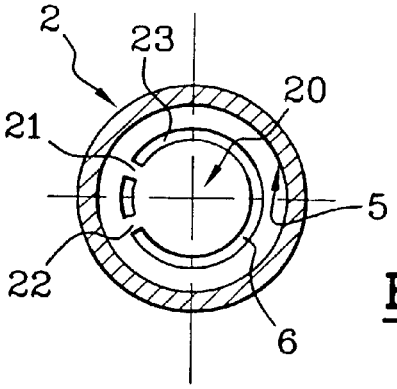
FIG. 3 is a view of a shut-off flap of the cap of FIG. 2.

As depicted in FIGS. 2 and 3, the body 2 of the cap 1 may comprise a covering skirt 8 of oblong cross section. The skirt 8 may be open at one end and closed at the other end by a transverse wall 4.

The transverse wall 4 can form a set-back part 9 oriented at right angles to the major axis of the cap 1, and may accommodate the lid 3 when the latter is in the closed position. Formed in this set-back part 9 of the wall 4 there may be a depression 5 at the bottom of which an orifice 6 is located for letting the product out. The product outlet orifice 6 may be arranged along an axis X different from an axis Y of the cap, which may coincide with the axis of the container 101 intended to be used with the cap 1.

Optionally, a sealing skirt 11 may be carried by the transverse wall 4 formed all around the depression 5 and optionally centered on the axis Y of the cap. This sealing skirt may be intended to be inserted in a sealed or substantially sealed manner inside the neck of the container 101.

Between the covering skirt 8 and the sealing skirt 11, there may be two skirt portions 12, 13, each carrying, near their free end, a bulge 14, 15 capable of collaborating in snap-fastening with a corresponding bulge formed on the exterior surface of the neck of the container 101.

In one optional embodiment, a valve, for example, a flap 20, may be arranged in the outlet orifice 6 and may be connected to an edge delimiting the orifice by two bridges of material 21, 22 in such a way as to form a hinge, to allow the flap 20 to pivot in response to the pressure of the product contained in the container 101. The flap 20 may be dimensioned so that, in the closed position, an annular passage 23 may remain between the peripheral edge of the flap 20 and the edge delimiting the outlet orifice 6, to allow air to be taken into the container 101.

By way of example, the outlet orifice 6 may have a diameter of about 4 mm. The shut-off flap 20 may have a diameter of about 3.6 mm and may be connected to the edge delimiting the outlet orifice 6 by two bridges of material 21, 22 each about 0.5 mm broad and about 0.25 mm thick. The thickness of the shut-off flap 20 may be about 0.7 mm. The two bridges of material 21, 22 may be separated by an angular distance of about 25°. All these parameters may be tailored to suit the material used, the product dispensed, and the desired convenience of dispensing, for example, the inertia of the system, and thus may vary according to differing conditions.

When the pressures are in equilibrium, the flap 20 may be in the closed position depicted in solid line. In this position, the degree of closure may be sufficient that, on the one hand, when the container is turned head down, at least for a relatively short period of time, product contained in the container may be prevented from flowing out under the effect of its weight and, on the other hand, any unwanted ingress of liquid, particularly water, into the container may be prevented. The annular passage 23 formed around the flap 20 may allow air to be taken into the container 101.

In one optional embodiment, to dispense a dose of the product, the user may press on the deformable walls 104, 105 of the container 101 to pressurize the product. The product under pressure may cause the flap 20 to bend in the direction away from the container 101 to uncover the outlet orifice 6 and allow product to flow out. The flap 20 may then be in the position depicted in broken line. By releasing the pressure exerted on the walls of the container 101, the flap 20 may return to its closed position, and may allow a volume of air substantially corresponding to the volume of product dispensed to enter the container 101 via the annular passage 23.

In one optional embodiment, the body 2 of the cap 1 may be connected to a lid 3 via a snap hinge 30 of the latch lock lever type. Such an articulation 30 may comprise a connecting element in the form of an elbow 31 connected on the one hand to the body 2 of the cap and on the other hand to the lid 3. On each side of the elbow 31, there may be formed two film hinges 32, 34 defining an axis of pivoting of the lid 3 with respect to the body 2. When the lid 3 is opened and closed, the elbow 31 may pass through an intermediate position in which it is wide open. Once this position of unstable equilibrium has been crossed, it may elastically return the lid either to the closed position or to the wide open position. The way in which such articulations work is well known, and therefore requires no further detailed description.

In an optional embodiment, a pip 7 may be formed on an interior face of the lid 3 which, when closed, may be capable of engaging inside the depression 5 to improve the sealing when closed.

Figure 4:
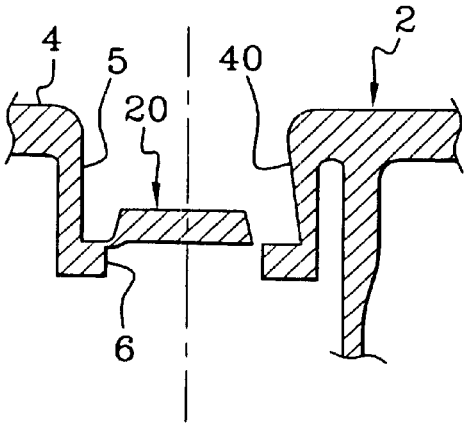
FIG. 4 is a schematic view of another embodiment of a portion of a cap.

FIG. 4 illustrates another optional embodiment. In the embodiment of FIG. 4, the cylindrical shape of the depression 5 at the bottom of which the outlet orifice 6 is made may be replaced by a profile capable of encouraging flow, (e.g., at a right angle with the outlet orifice 6). The arrangement may encourage flow of the product through the orifice. For this purpose, on the side of the flap 20 opposite the one adjacent to the hinge-forming bridge(es) 21, 22, the depression 5 may have a profile 40 which, in the direction away from the outlet orifice 6, converges gradually towards the axis X thereof.

Figure 6:
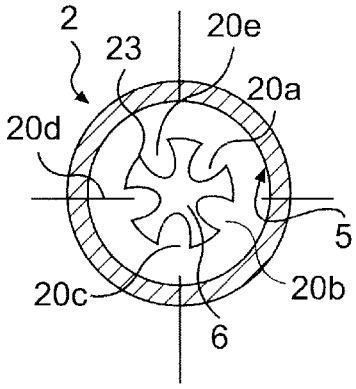
FIG. 6 is a schematic view showing a plurality of shut-off flaps of the cap.

In another optional embodiment, as shown in FIG. 6, the valve associated with the orifice may comprise of a plurality of flaps 20*a*–20*e*. Optionally, several flaps may be located annularly around the orifice as shown in FIG. 6 and operate in a manner similar to the manner already described herein.

Figure 5:
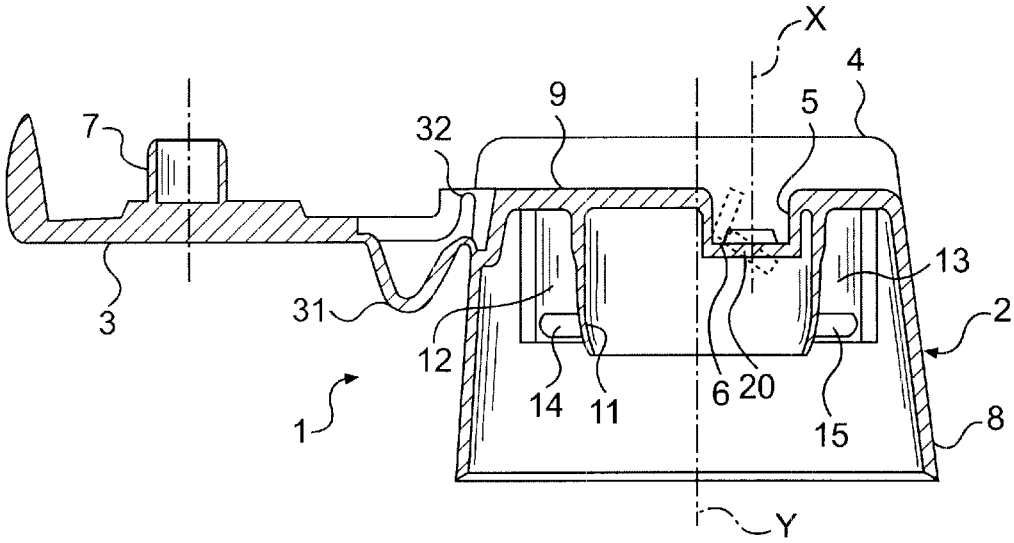
FIG. 5 is a cross-sectioned view of a cap according to another embodiment of the invention.
Figure 7:
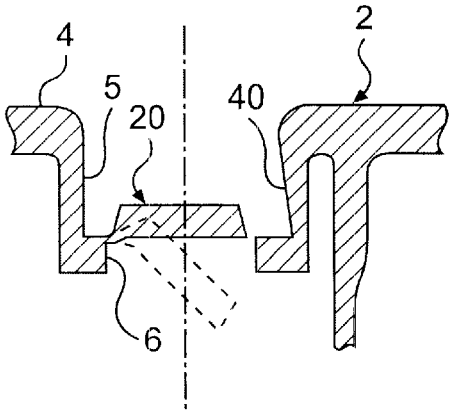
FIG. 7 is a partial schematic view of another embodiment of a portion of the cap.

FIGS. 5 and 7 show an optional embodiment wherein the shut-off flap may move beyond a shut-off position to a third position, inward toward the container to allow air to enter the container. FIG. 5 shows three positions a shut-off flap may achieve. The shut-off position is in solid lines and an open position and a position past shut-off inward toward the container or to permit the ingress of air are both shown in dashed lines.

FIG. 7 shows the shut-off position in solid lines and the past shut-off position in dashed lines. The optional past shut-off position may permit air to enter the container after an increase in pressure within the container ceases.

It will be apparent to those skilled in the art that various modifications and variations can be made to the structure and methodology of the present invention. Thus, it should be understood that the invention is not limited to the embodiments and examples discussed in the specification. Rather the present invention is intended to cover modification and variations.

What is claimed is:

1. A cap for a container, comprising:

a body;

an outlet orifice for dispensing a product from the container;

a lid configured to selectively cover at least a portion of the outlet orifice;

a snap hinge coupling the lid to the body; and at least one shut-off flap, the at-least one shut-off flap selectively allowing the product to be dispensed from the outlet orifice, wherein the at least one shut-off flap and the body are a single piece formed of a material substantially the same as a material forming the snap hinge.

2. The cap of claim 1, wherein the at least one shut-off flap is configured to move from a first position covering the outlet orifice to a second position enabling the product to be dispensed from the outlet orifice in response to an increased pressure in the container, and wherein the at least one shut-off flap is configured to return to the first position when the increased pressure ceases.

3. The cap of claim 2, wherein the at least one shut-off flap is configured to move from the first position to the second position by bending.

4. The cap of claim 2, wherein the at least one shut-off flap is configured to move to a third position inward toward the container to allow air to enter the container when the increased pressure in the container ceases.

5. The cap of claim 1, wherein the at least one shut-off flap is configured to provide a liquid-tight seal for the outlet orifice when the at least one shut-off flap is in a first position.

6. The cap of claim 1, wherein the at least one shut-off flap is configured to allow air to enter the container to compensate for a volume of the product dispensed when the at least one shut-off flap is in first position.

7. The cap of claim 1, wherein the cap is a single piece formed by molding.

8. The cap of claim 7, wherein the cap is formed by molding a polypropylene material.

9. The cap of claim 1, further comprising at least one bridge of material forming a hinge coupling the at least one shut-off flap to the body.

10. The cap of claim 9, wherein the at least one bridge of material comprises two bridges of material located at a non-zero distance apart from one another.

11. The cap of claim 9, wherein the outlet orifice is located at a bottom of a cavity defined by the body, the cavity having a first side located adjacent to the at least one bridge of material, and a second side substantially opposite to the first side, and wherein a profile of the second side is inclined with respect to the first side.

12. The cap of claim 1, further comprising means for mounting the cap on the container.

13. The cap of claim 12, wherein the mounting means is configured to cooperate with corresponding means on the container so as to allow the cap to be coupled to the container by at least one of snap fastening and screwing.

14. A packaging and dispensing assembly, comprising:

the cap of claim 1; and a container, the cap being on the container.

15. The assembly of claim 14, wherein the container comprises a free edge defining an opening of the container, the cap selectively covering the opening of the container.

16. The assembly of claim 14, further comprising a product in the container.

17. The assembly of claim 16, wherein the product is a cosmetic product.

18. The assembly of claim 17, wherein the cosmetic product is at least one of a hair product and a care product.

19. A method of applying a product, comprising:

providing the assembly of claim 16;

dispensing the product from the container; and applying the product to a surface.

20. The method of claim 19, wherein the product comprises one of a cosmetic product and a care product, and wherein the applying comprises applying the product a body part.

21. The method of claim 19, wherein the dispensing comprises applying a force to an outer surface of the container.

22. The method of claim 21, wherein the force is applied in a direction substantially perpendicular to the outer surface of the container.

23. The method of claim 21, wherein the applying of the force comprises squeezing the container.

24. The assembly of claim 14, wherein the container comprises at least one wall capable of deforming from an initial shape in response to a pressure exerted at a right angle with respect to a surface thereof, and of returning substantially to the initial shape when the exertion of pressure ceases.

25. The cap of claim 1, wherein a modulus of elasticity associated with the material comprising the cap is at least about 1450 MPa.

26. A cap for a container, comprising:

a body;

an outlet orifice for dispensing a product from the container;

a lid pivotally coupled to the body, the lid being configured to selectively cover at least a portion of the outlet orifice; and a valve associated with the outlet orifice, the valve selectively allowing a product to be dispensed from the outlet orifice, wherein the body and the valve comprise a single piece formed of a material substantially the same as a material forming the lid, and wherein the valve is configured to allow air to enter the container to compensate for a volume of the product dispensed when the valve is in a first position.

27. The cap of claim 26, further comprising a snap hinge coupling the lid to the body.

28. The cap of claim 27, wherein the body and the valve comprise a single piece formed of a material substantially the same as a material forming the snap hinge.

29. The cap of claim 26, wherein the valve comprises at least one shut-off flap configured to selectively allow product to be dispensed from the container.

30. The cap of claim 26, wherein the valve is configured to move from a first position covering the outlet orifice to a second position enabling the product to be dispensed from the outlet orifice in response to an increased pressure in the container and wherein the valve is configured to return to the first position when the increased pressure ceases.

31. The cap of claim 30, wherein the valve is configured to move from the first position to the second position by bending.

32. The cap of claim 26, wherein the valve is configured to provide a liquid-tight seal for the outlet orifice when the valve is in a first position.

33. The cap of claim 26, wherein the cap is a single piece formed by molding.

34. The cap of claim 33, wherein the cap is formed by molding a polypropylene material.

35. The cap of claim 26, further comprising at least one bridge of material forming a hinge coupling the valve to the body.

36. The cap of claim 35, wherein the at least one bridge of material comprises two bridges of material located at a non-zero distance apart from one another.

37. The cap of claim 35, wherein the outlet orifice is located at a bottom of a cavity defined by the body, the cavity having a first side located adjacent to the at least one bridge of material, and second side substantially opposite to the first side, and wherein a profile of the second side is inclined with respect to the first side.

38. The cap of claim 26, further comprising means for mounting the cap on the container.

39. The cap of claim 38, wherein the mounting means is configured to cooperate with corresponding means on the container so as to allow the cap to be coupled to the container by at least one of snap fastening and screwing.

40. A packaging and dispensing assembly, comprising:

the cap of claim 26; and a container, the cap being on the container.

41. The assembly of claim 40, wherein the container comprises a free edge defining an opening of the container, the cap selectively covering the opening of the container.

42. The assembly of claim 40, further comprising a product in the container.

43. The assembly of claim 42, wherein the product is a cosmetic product.

44. The assembly of claim 43, wherein the cosmetic product is at least one of a hair product and a care product.

45. A method of applying a product, comprising:

providing the assembly of claim 42;

dispensing the product from the container; and applying the product to a surface.

46. The method of claim 45, wherein the product comprises one of a cosmetic product and a care product, and wherein the applying comprises applying the product to a body part.

47. The method of claim 45, wherein the dispensing comprises applying a force to an outer surface of the container.

48. The method of claim 47, wherein the force is applied in a direction substantially perpendicular to the outer surface of the container.

49. The method of claim 47, wherein the applying of the force comprises squeezing the container.

50. The assembly of claim 40, wherein the container comprises at least one wall capable of deforming from an initial shape in response to a pressure exerted at a right angle with respect to a surface thereof and of returning substantially to the initial shape when the exertion of pressure ceases.

51. The cap of claim 26, wherein a modulus of elasticity associated with the material comprising the cap is at least about 1450 MPa.

52. A cap for a container, comprising:

a body;

an outlet orifice for dispensing a product from the container;

a lid pivotally coupled to the body, the lid being configured to selectively cover at least a portion of the outlet orifice; and a valve associated with the outlet orifice, the valve selectively allowing a product to be dispensed from the outlet orifice, wherein the body and the valve comprise a single piece formed of a material substantially the same as a material forming the lid, wherein the valve is configured to move from a first position covering the outlet orifice to a second position enabling the product to be dispensed from the outlet orifice in response to an increased pressure in the container and wherein the valve is configured to return to the first position when the increased pressure ceases, and wherein the valve is configured to move to a third position inward toward the container to allow air to enter the container when the increased pressure in the container ceases.

53. A cap for a container, comprising:

a body;

an outlet orifice for dispensing a product from the container;

a lid coupled to the body, the lid being configured to selectively cover at least a portion of the outlet orifice; and a valve associated with the outlet orifice, wherein the body, the lid, and the valve comprise a single piece formed by molding, and wherein the valve is configured to allow air to enter the container to compensate for a volume of the product dispensed when the valve is in a first position.

54. The cap of claim 53, wherein a modulus of elasticity associated with the material comprising the cap is at least about 1450 MPa.

55. The cap of claim 53, wherein the valve is configured to move from a first position covering the outlet orifice to a second position enabling the product to be dispensed from the outlet orifice in response to an increased pressure in the container, and wherein the valve is configured to return to the first position when the increased pressure ceases.

56. The cap of claim 53, wherein the valve is configured to move from a first position to a second position by bending.

57. The cap of claim 53, wherein the valve is configured to provide a liquid-tight seal for the outlet orifice when the valve is in a first position.

58. The cap of claim 53, wherein the cap is formed by molding a polypropylene material.

59. The cap of claim 53, further comprising at least one bridge of material forming a hinge coupling the valve to the body.

60. The assembly of claim 59, wherein the at least one bridge of material comprises two bridges of material located at a non-zero distance apart from one another.

61. The cap of claim 59, wherein the outlet orifice is located at a bottom of a cavity defined by the body, the cavity having a first side located adjacent to the at least one bridge of material, and a second side substantially opposite to the first side, and wherein a profile of the second side is inclined with respect to the first side.

62. The cap of claim 53, further comprising means for mounting the cap on the container.

63. The cap of claim 62, wherein the mounting means is configured to cooperate with corresponding means on the container so as to allow the cap to be coupled to the container by a least one of snap fastening and screwing.

64. A packaging and dispensing assembly, comprising:

the cap of claim 53; and a container, the cap being on the container.

65. The assembly of claim 64, wherein the container comprises a free edge defining an opening of the container, the cap selectively covering the opening of the container.

66. The assembly of claim 64, further comprising a product in the container.

67. The assembly of claim 66, wherein the product is a cosmetic product.

68. The assembly of claim 67, wherein the cosmetic product is at least one of a hair product and a care product.

69. A method of applying a product, comprising:

providing the assembly of claim 66;

dispensing the product from the container; and applying the product to a surface.

70. The method of claim 69, wherein the product comprises one of a cosmetic product and a care product, and wherein the applying comprises applying the product to a body part.

71. The method of claim 69, wherein the dispensing comprises applying a force to an outer surface of the container.

72. The method of claim 71, wherein the force is applied in a direction substantially perpendicular to the outer surface of the container.

73. The method of claim 71, wherein the applying of the force comprises squeezing the container.

74. The assembly of claim 64, wherein the container comprises at least one wall capable of deforming from an initial shape in response to a pressure exerted at a right angle with respect to a surface thereof and of returning substantially to the initial shape when the exertion of pressure ceases.

75. A cap for a container, comprising:

a body;

an outlet orifice for dispensing a product from the container;

a lid coupled to the body, the lid being configured to selectively cover at least a portion of the outlet orifice; and a valve associated with the outlet orifice, wherein the body, the lid, and the valve comprise a single piece formed by molding, wherein the valve is configured to move from a first position covering the outlet orifice to a second position enabling the product to be dispensed from the outlet orifice in response to an increased pressure in the container, and wherein the valve is configured to return to the first position when the increased pressure ceases, and wherein the valve is configured to move to a third position inward toward the container to allow air to enter the container when an increased pressure in a container ceases.

* * * * *

UNITED STATES PATENT AND TRADEMARK OFFICE

CERTIFICATE OF CORRECTION

PATENT NO. : 6,575,330 B2
DATED : June 10, 2003
INVENTOR(S) : Guilhem Rousselet

It is certified that error appears in the above-identified patent and that said Letters Patent is hereby corrected as shown below:

Column 8,
Line 62, “at-least” should read -- at least --.

Column 9,
Line 21, “in first” should read -- in a first --.
Line 63, “product a” should read -- product to a --.

Column 12,
Line 33, “assembly” should read -- cap --.
Line 47, “by a least” should read -- by at least --.

Signed and Sealed this

Twelfth Day of August, 2003

JAMES E. ROGAN
*Director of the United States Patent and Trademark Office*